US010458438B2

(12) United States Patent
Nakaniwa et al.

(10) Patent No.: US 10,458,438 B2
(45) Date of Patent: Oct. 29, 2019

(54) CENTRIFUGAL COMPRESSOR

(71) Applicant: MITSUBISHI HEAVY INDUSTRIES COMPRESSOR CORPORATION, Hiroshima-shi, Hiroshima (JP)

(72) Inventors: Akihiro Nakaniwa, Tokyo (JP); Shinichiro Tokuyama, Hiroshima (JP)

(73) Assignee: MITSUBISHI HEAVY INDUSTRIES COMPRESSOR CORPORATION, Hiroshima (JP)

( * ) Notice: Subject to any disclaimer, the term of this patent is extended or adjusted under 35 U.S.C. 154(b) by 318 days.

(21) Appl. No.: 15/503,621

(22) PCT Filed: Apr. 17, 2015

(86) PCT No.: PCT/JP2015/061884
§ 371 (c)(1),
(2) Date: Feb. 13, 2017

(87) PCT Pub. No.: WO2016/042825
PCT Pub. Date: Mar. 24, 2016

(65) Prior Publication Data

US 2017/0254344 A1 Sep. 7, 2017

(30) Foreign Application Priority Data

Sep. 19, 2014 (JP) ..... 2014-190635

(51) Int. Cl.
*F04D 29/70* (2006.01)
*F04D 29/44* (2006.01)
(Continued)

(52) U.S. Cl.
CPC ..... *F04D 29/705* (2013.01); *F01D 25/002* (2013.01); *F04D 29/4213* (2013.01);
(Continued)

(58) Field of Classification Search
CPC .... F01D 25/002; F04D 17/122; F02C 7/1435; F02C 3/30; F02C 3/305; F01K 21/04
See application file for complete search history.

(56) References Cited

U.S. PATENT DOCUMENTS 7,648,331 B2 1/2010 Spakovszky et al.
8,337,630 B2 12/2012 de la Bruere-Terreault et al.
(Continued)

FOREIGN PATENT DOCUMENTS

AU 705794 B2 10/1997
CH 173146 A 11/1934
(Continued)

OTHER PUBLICATIONS

International Preliminary Report on Patenability and Written Opinion of the International Searching Authority (Forms PCT/IB/338, PCT/IB/373, PCT/ISA/237 and PCT/IB/326), dated Mar. 30, 2017, for International Application No. PCT/JP2015/061884, with English translation.

(Continued)

*Primary Examiner* — Carlos A Rivera
*Assistant Examiner* — Behnoush Haghighian
(74) *Attorney, Agent, or Firm* — Birch Stewart Kolasch & Birch LLP

(57) ABSTRACT

A centrifugal compressor includes: a rotational shaft; a main casing surrounding at least a part of the rotational shaft, the main casing having an inlet and an outlet separated from each other in an axial direction of the rotational shaft and an annular space surrounding a section of the rotational shaft at a side of the inlet and communicating with the inlet; at least one impeller disposed in a fixed state to the rotational shaft inside the main casing; a flow guide member disposed inside the annular space and extending along the axial direction of the rotational shaft; a plurality of injection holes disposed
(Continued)

along the flow guide member and separated from one another along the axial direction of the rotational shaft; and a flow path which extends inside the annular space and through which a cleaning fluid to be supplied to the plurality of injection holes is capable of flowing.

7 Claims, 6 Drawing Sheets

(51) Int. Cl.

| | |
|---|---|
| ***F04D 29/42*** | (2006.01) |
| ***F01D 25/00*** | (2006.01) |
| *F04D 17/12* | (2006.01) |
| *F04D 29/40* | (2006.01) |

(52) U.S. Cl.
CPC ..... *F04D 29/4246* (2013.01); *F04D 29/44* (2013.01); *F04D 29/442* (2013.01); *F04D 29/444* (2013.01); *F04D 17/122* (2013.01); *F04D 29/40* (2013.01); *F05D 2210/30* (2013.01); *F05D 2210/42* (2013.01); *F05D 2210/43* (2013.01); *F05D 2260/607* (2013.01)

(56) References Cited

U.S. PATENT DOCUMENTS

| | | | |
|---|---|---|---|
| 2010/0212703 A1 | 8/2010 | de la Bruere-Terreault et al. | |
| 2012/0186605 A1* | 7/2012 | Nakaniwa | F04D 17/10 134/24 |

FOREIGN PATENT DOCUMENTS

| | | | |
|---|---|---|---|
| CN | 1214760 | A | 4/1999 |
| CN | 101180468 | A | 5/2008 |
| EP | 1 593 854 | A2 | 11/2005 |
| EP | 2 530 322 | A1 | 12/2012 |
| JP | 56-43433 | | 4/1981 |
| JP | 56-165800 | A | 12/1981 |
| JP | 61-108900 | U | 7/1986 |
| JP | 6-33899 | A | 2/1994 |
| JP | 8-338397 | A | 12/1996 |
| JP | 2011-74888 | A | 4/2011 |
| JP | 2013-177905 | A | 9/2013 |
| JP | 2013-199941 | A | 10/2013 |
| JP | 5307680 | B2 | 10/2013 |
| JP | 2015-75034 | A | 4/2015 |
| JP | 2015-75035 | A | 4/2015 |
| WO | 2004/055334 | A1 | 7/2004 |
| WO | 2011/093384 | A1 | 8/2011 |
| WO | 2016-40529 | A | 3/2016 |

OTHER PUBLICATIONS

Extended European Search Report dated Apr. 23, 2018 issued to the corresponding EP Application No. 15842368.1.
Office Action effective Jun. 6, 2018 issued to the corresponding CN Application No. 201580034627.1 with a Machine Translation.
International Search Report issued in PCT/JP2015/061884 (PCT/ISA/210), dated Jul. 21, 2015.

* cited by examiner

CENTRIFUGAL COMPRESSOR

TECHNICAL FIELD

The present disclosure relates to a centrifugal compressor.

BACKGROUND ART

Patent Document 1 discloses a main casing having an inlet and an outlet, and an impeller disposed rotatably inside the main casing. Such a centrifugal compressor further includes a supply pipe for supplying a cleaning liquid for cleaning the impeller, and a cleaning-liquid injection nozzle for injecting the cleaning liquid supplied from the supply pipe to the surface of the impeller, disposed on the inlet side of the main casing. With such a centrifugal compressor, dust adhering to the surface of the impeller is washed off by the cleaning liquid.

CITATION LIST

Patent Literature

Patent Document 1: JPH8-338397A

SUMMARY

Problems to be Solved

The centrifugal compressor disclosed in Patent Document 1 includes one cleaning-liquid injection nozzle disposed in the vicinity of an inlet of a main casing, and a cleaning liquid is injected from the cleaning-liquid injection nozzle. In this case, only one cleaning-liquid injection nozzle is provided, and the distance between the cleaning-liquid injection nozzle and the impeller is short, which makes it difficult for the cleaning liquid injected from the cleaning-liquid injection nozzle to spread out sufficiently before reaching the impeller. Thus, the cleaning liquid is not distributed evenly over the entire region of the flow-path width, and there is a risk that the entire surface of the impeller cannot be cleaned sufficiently and evenly.

In view of the above issue, an object of at least one embodiment of the present invention is to provide a centrifugal compressor whereby the cleaning liquid is distributed evenly over the entire region of the flow-path width, and the entire surface of the impeller can be cleaned sufficiently and evenly.

Solution to the Problems (1) A centrifugal compressor according to at least one embodiment of the present invention comprises: a rotational shaft; a main casing surrounding at least a part of the rotational shaft, the main casing having an inlet and an outlet separated from each other in an axial direction of the rotational shaft and an annular space surrounding a section of the rotational shaft at a side of the inlet and communicating with the inlet; at least one impeller disposed in a fixed state to the rotational shaft inside the main casing; a flow guide member disposed inside the annular space and extending along the axial direction of the rotational shaft; a plurality of injection holes disposed along the flow guide member and separated from one another along the axial direction of the rotational shaft; and a flow path which extends inside the annular space and through which a cleaning fluid to be supplied to the plurality of injection holes is capable of flowing.

With the above configuration (1), the cleaning liquid is distributed evenly over the entire region of the flow-path width as described below, and it is possible to clean the entire surface of the impeller sufficiently and evenly.

A leading edge of the impeller faces the annular space along the axial direction of the rotational shaft, through an opening of an annular shape about the rotational shaft inside the main casing, which is an impeller inlet. A fluid having flown into the inlet of the main casing flows along the circumferential direction of the rotational shaft inside the annular space, and then flows toward the impeller inlet along the radial direction of the rotational shaft. The flowing direction of the fluid gradually changes from the radial direction to the axial direction in the vicinity of the impeller inlet, and the fluid flows into the impeller inlet along the axial direction.

In accordance with such a change in the flow direction, the width direction of the flow of the fluid also changes. Specifically, the width direction of the flow is the same as the axial direction of the rotational shaft when the fluid is flowing along the circumferential direction or along the radial direction of the rotational shaft inside the annular space, and is the same as the radial direction of the rotational shaft when the fluid is flowing along the axial direction after flowing into the impeller inlet.

The flow guide member disposed in the annular space has a function to assist a change in the flow direction of the fluid from the circumferential direction to the radial direction of the rotational shaft.

With the above configuration (1), the cleaning liquid is injected through the plurality of injection holes disposed along the flow guide member, and the cleaning liquid after injection is transported by the fluid flowing along the circumferential direction or the radial direction inside the annular space. Furthermore, since the plurality of injection holes are separated from one another along the axial direction of the rotational shaft, the cleaning liquid immediately after injection is dispersed in the axial direction of the rotational shaft, i.e., in the width direction of the flow of the fluid.

Thanks to dispersion of the cleaning liquid immediately after injection in the width direction of the flow, the cleaning liquid maintains a state of being dispersed in the width direction of the flow, i.e., in the radial direction of the rotational shaft, after the flow direction of the fluid changes from the radial direction to the axial direction of the rotational shaft, i.e., after the fluid flows into the impeller inlet. Accordingly, when the cleaning liquid reaches the impeller, the cleaning liquid is distributed evenly over the entire region of the flow-path width, and the entire surface of the impeller can be cleaned sufficiently and evenly.

(2) In some embodiments, in the above configuration (1), the flow guide member is disposed on a side opposite from the inlet in a circumferential direction of the rotational shaft.

With the above configuration (2), since the flow guide member is disposed on the opposite side from the inlet in the circumferential direction of the rotational shaft, the cleaning liquid immediately after injection is dispersed in the axial direction of the rotational shaft, i.e., in the width direction of the fluid, from the opposite side from the inlet.

Furthermore, since the injection holes are disposed along the flow guide member disposed on the opposite side from the inlet, the cleaning liquid injected from the injection holes is less likely to adhere to the inner wall surface of the inlet side of the main casing. In this way, it is possible to reduce the amount of waste cleaning liquid that is not used in cleaning of the impellers.

(3) In some embodiments, in the above configuration (1) or (2), the flow guide member has a flow guide element extending along a radial direction of the rotational shaft. At least a part of the plurality of injection holes is disposed on a surface of the flow guide element.

With the above configuration (3), at least a part of the injection holes is disposed on the surface of the flow guide element extending along the radial direction of the rotational shaft, and the cleaning liquid immediately after injection is transported by the fluid flowing along the surface of the flow guide element. Furthermore, since the plurality of injection holes are separated from one another along the axial direction of the rotational shaft, the cleaning liquid immediately after injection is dispersed in the width direction of the flow guide element, i.e., in the width direction of the flow of the fluid.

(4) In some embodiments, in the above configuration (3), the flow guide element constitutes a part of an inlet guide-vane row disposed in the annular space.

With the above configuration (4), since the flow guide element constitutes a part of the inlet guide-vane row disposed in the annular space, the cleaning liquid immediately after injection is dispersed in the axial direction of the rotational shaft, i.e., in the width direction of the flow of the fluid, from the inlet guide vanes.

(5) In some embodiments, in the above configuration (3) or (4), the flow guide member has a blade element which gradually reduces a flow-path cross sectional area of the annular space from the inlet toward the flow guide element.

With the above configuration (5), the flow guide member is provided with the blade element that gradually reduces the flow-path cross-sectional area of the annular space from the inlet toward the flow guide element, and thus a speed decrease of the fluid flowing from the inlet toward the flow guide element is suppressed.

(6) In some embodiments, in any one of the above configurations (1) to (5), at least a part of the plurality of injection holes is arranged in a line along the axial direction of the rotational shaft.

With the above configuration (6), at least a part of the injection holes is disposed in a line along the axial direction of the rotational shaft, and the cleaning liquid immediately after injection is distributed evenly in the fluid flowing along the circumferential direction or along the radial direction inside the annular space. Since the cleaning liquid immediately after injection is distributed evenly in the fluid, the cleaning liquid immediately after injection is dispersed evenly in the axial direction of the rotational shaft, i.e., in the width direction of the fluid.

(7) In some embodiments, in any one of the above configurations (1) to (5), at least a part of the plurality of injection holes is arranged in a staggered fashion along the axial direction of the rotational shaft.

With the above configuration (7), at least a part of the injection holes is disposed in a staggered fashion along the axial direction of the rotational shaft, and the cleaning liquid immediately after injection is distributed evenly and densely in the fluid flowing along the circumferential direction or along the radial direction inside the annular space, without interfering with each other. Since the cleaning liquid immediately after injection is distributed evenly and densely in the fluid, the cleaning liquid immediately after injection is dispersed in the axial direction of the rotational shaft, i.e., in the width direction of the fluid.

Advantageous Effects

According to at least one embodiment of the present invention, it is possible to provide a centrifugal compressor whereby the cleaning liquid is distributed evenly over the entire region of the flow-path width, and the entire surface of an impeller can be cleaned sufficiently and evenly.

DETAILED DESCRIPTION

Embodiments of the present invention will now be described in detail with reference to the accompanying drawings. It is intended, however, that unless particularly specified, dimensions, materials, shapes, relative positions and the like of components described in the embodiments shall be interpreted as illustrative only and not intended to limit the scope of the present invention.

For instance, an expression of relative or absolute arrangement such as "in a direction", "along a direction", "parallel", "orthogonal", "centered", "concentric" and "coaxial" shall not be construed as indicating only the arrangement in a strict literal sense, but also includes a state where the arrangement is relatively displaced by a tolerance, or by an angle or a distance whereby it is possible to achieve the same function.

Further, for instance, an expression of a shape such as a rectangular shape or a cylindrical shape shall not be construed as only the geometrically strict shape, but also includes a shape with unevenness or chamfered corners within the range in which the same effect can be achieved.

On the other hand, an expression such as "comprise", "include", "have", "contain" and "constitute" are not intended to be exclusive of other components.

Figure 1:
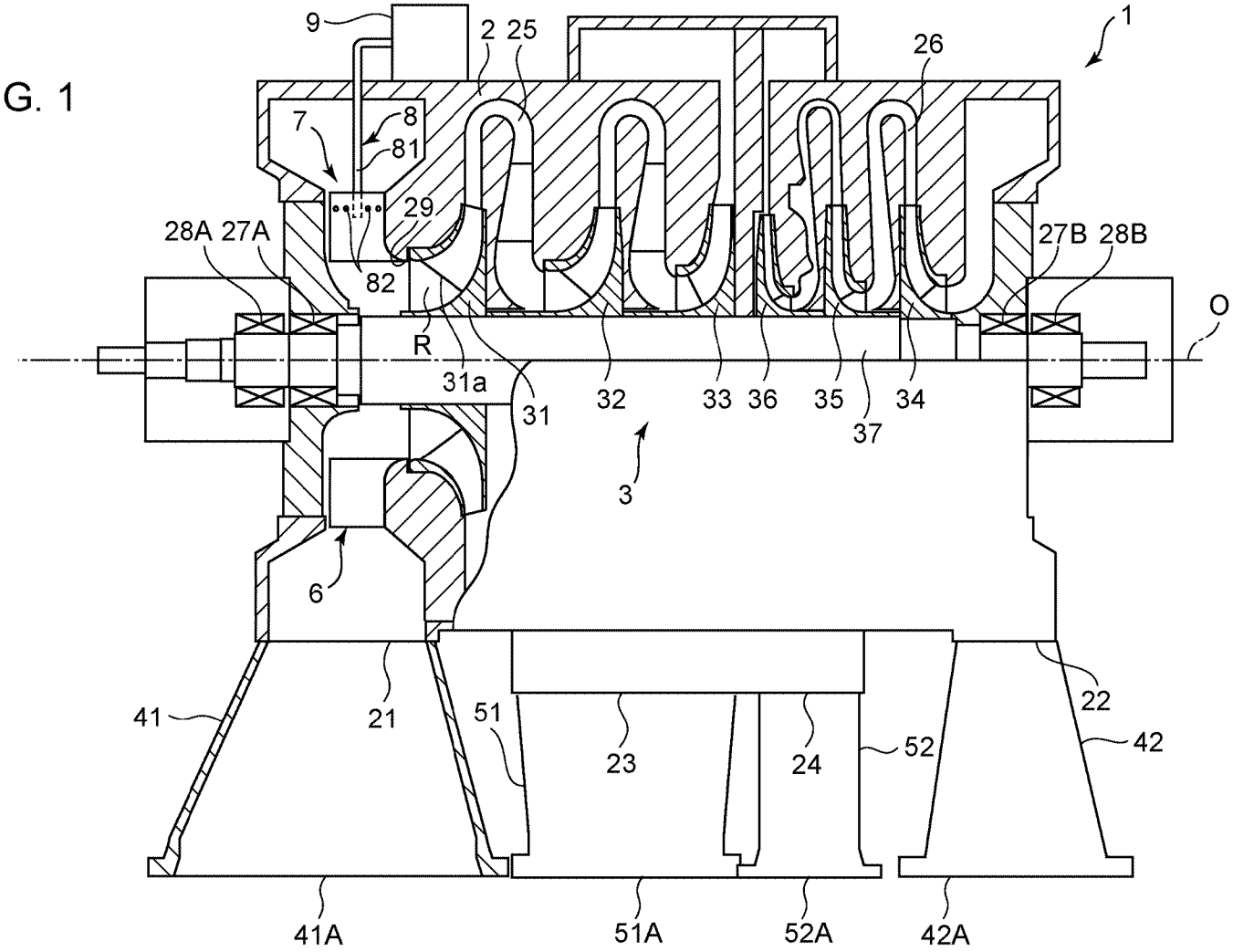
FIG. 1 is a vertical cross-sectional view schematically showing a configuration of a centrifugal compressor according to an embodiment of the present invention.
Figure 2:
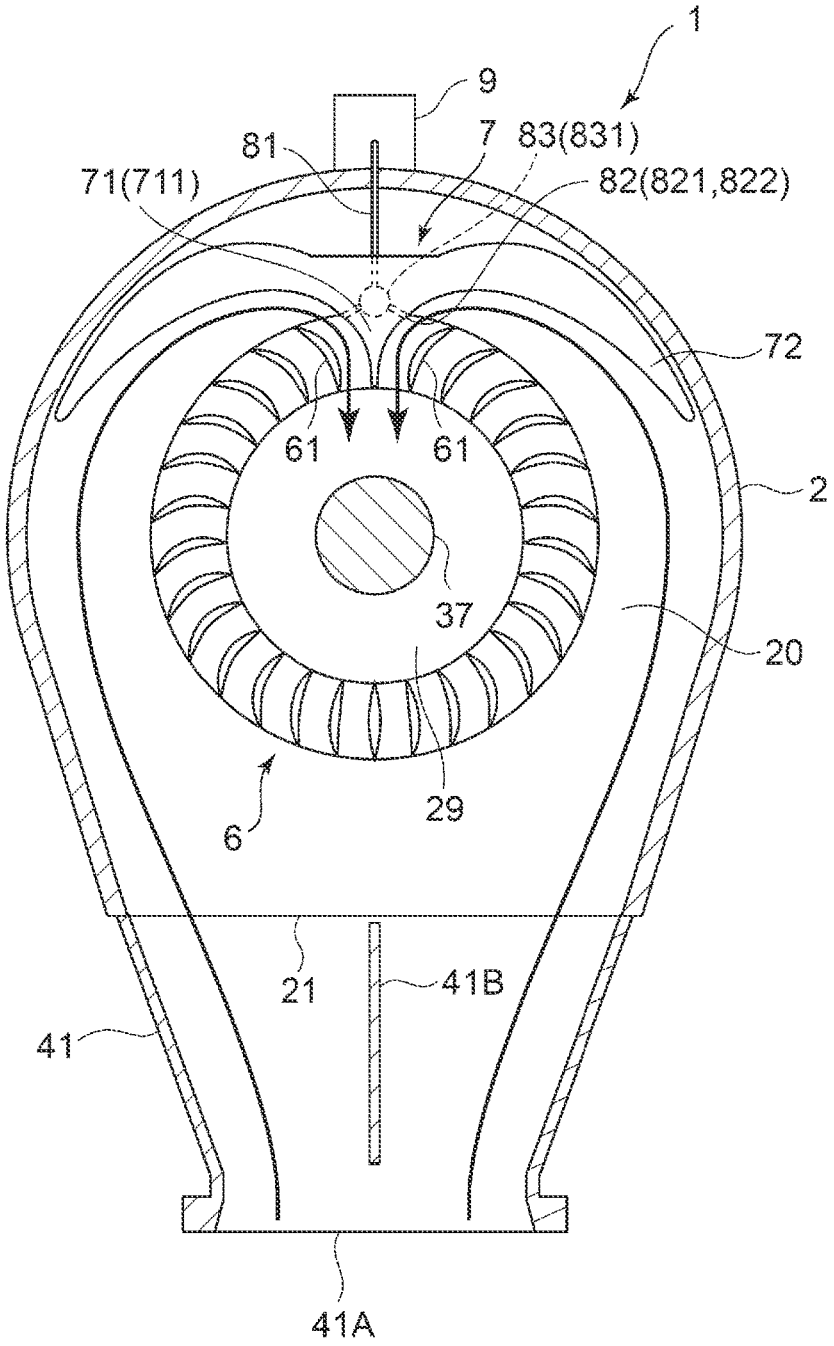
FIG. 2 is a transverse cross-sectional view schematically showing a centrifugal compressor according to an embodiment.
Figure 3:
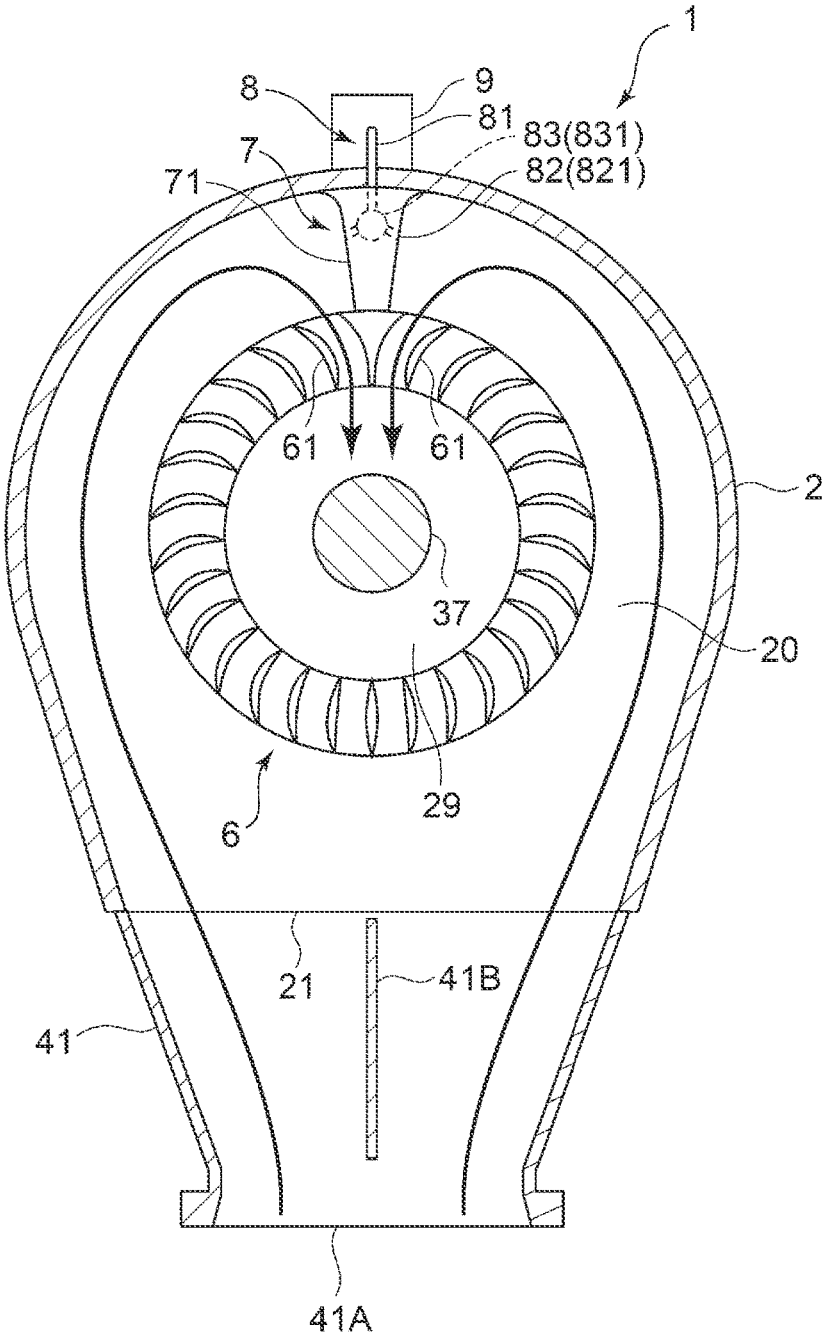
FIG. 3 is a transverse cross-sectional view schematically showing a centrifugal compressor according to an embodiment.

FIG. 1 is a vertical cross-sectional view schematically showing a configuration of a centrifugal compressor 1 according to an embodiment of the present invention. FIGS. 2 and 3 are each a transverse cross-sectional view schematically showing a flow guide member according to an embodiment.

As depicted in FIG. 1, the centrifugal compressor 1 according to an embodiment of the present invention is a centrifugal compressor of a single-shaft multi-stage centrifugal type which includes a rotational shaft 37, a main casing 2, at least one impeller 3, intake casings 41, 42, discharge casings 51, 52, an inlet guide-vane row 6, a flow guide member 7, a cleaning-liquid injection device 8, and a cleaning-liquid supply device 9.

The rotational shaft 37 is disposed rotatably through the main casing 2. Specifically, the rotational shaft 37 is supported rotatably by journal bearings 27A, 27B and thrust bearings 28A, 28B disposed on either side of the main casing 2.

The main casing 2 surrounds at least a part of the rotational shaft 37, and includes inlets 21, 22 and outlets 23, 24 spaced from one another in an axial direction of the rotational shaft 37, and an annular space 20 surrounding a section of the rotational shaft 37 at the side of the inlet 21 and communicating with the inlet 21.

The main casing 2 according to the present embodiment includes two inlets 21, 22 and two outlets 23, 24.

The inlets 21, 22 and the outlets 23, 24 are arranged along the rotational shaft 37, and the inlet 21, the outlet 23, the outlet 24, and the inlet 22 are arranged in this order from the left in FIG. 1. The inlet 21 and the outlet 23 are adjacent and make a pair, while the inlet 22 and the outlet 24 are adjacent and make another pair. The outlet 23 and the inlet 22 are connected to each other by non-depicted piping.

The main casing 2 houses at least one impeller 3 fixed to the rotational shaft 37, including impellers 31 to 33, and impellers 34 to 36.

The impellers 31 to 33 and the impellers 34 to 36 are fixed to the rotational shaft 37 concentrically. Specifically, the impellers 31 to 33 are fixed in series to a section of the rotational shaft 37 extending between the inlet 21 and the outlet 23, while the impellers 34 to 36 are fixed in series to a section of the rotational shaft 37 extending between the inlet 22 and the outlet 24.

Each of the impellers 31 to 33 and the impellers 34 to 36 forms a flow path R inside the main casing 2. Diffusers 25, 26 are disposed in the main casing 2, serving as a hydrostatic path connecting the flow paths R of the impellers 31 to 33 and of the impellers 34 to 36 in series.

The intake casings 41, 42 have intake ports 41A, 42A connected to the inlets 21, 22 and disposed separate from the inlets 21, 22 in an axial direction of the intake casings 41, 42, for instance, in a lower part of the intake casings 41, 42. The intake casings 41, 42 are reduced in diameter from the intake ports 41A, 42A toward the inlets 21, 22, and the flow-path cross-sectional areas gradually decrease from the intake ports 41A, 42A toward the inlets 21, 22. In the present embodiment, the intake casings 41, 42 have a flow-path cross-sectional shape gradually changing from a circular shape to a rectangular shape from the side of the intake ports 41A, 42A toward the side of the inlets 21, 22, so that the flow-path cross-sectional shape at the side of the intake ports 41A, 42A has a circular shape and the flow-path cross-sectional shape at the side of the inlets 21, 22 has a rectangular shape. Furthermore, in the present embodiment, a partition wall 41B (see FIGS. 2 and 3) is provided so as to extend in the axial direction inside the intake casing 41, and thereby the inside of the intake casing 41 is divided into two sections.

The discharge casings 51, 52 have discharge ports 51A, 52A connected to the outlets 23, 24 and disposed separate from the outlets 23, 24 in the axial directions of the discharge casings 51, 52, for instance, in a lower part of the discharge casings 51, 52. For instance, the axial directions of the intake casings 41, 42 and the axial directions of the discharge casings 51, 52 are orthogonal to the axial direction of the rotational shaft 37.

As depicted in FIGS. 2 and 3, the inlet guide-vane row 6 according to the present embodiment is disposed on the inlet side in the axial direction of the main casing 2, and a plurality of inlet guide vanes 61 constituting the inlet guide-vane row 6 are arranged along the radial direction of the rotational shaft 37. Accordingly, a fluid taken in through the inlet 21 passes between the inlet guide vanes 61 to flow along the axial direction of the rotational shaft 37. The flow of the fluid in the radial direction turns into a flow in the axial direction and is supplied to the impellers 3.

In the present embodiment, the plurality of inlet guide vanes 61 of the inlet guide-vane row 6 are disposed in reflective symmetry with respect to a plane passing through the center of the inlet 21 and including the axis O, and for instance, disposed symmetric with respect to the rotational shaft 37. The plurality of inlet guide vanes 61 is disposed so that the distribution becomes gradually less dense with a distance from the inlet 21, as seen along the rotational shaft 37.

The flow guide member 7 is disposed in an annular space, so as to extend along the axial direction of the rotational shaft 37. The flow guide member 7 according to the present embodiment has a predetermined blade width (span) A (see FIGS. 7 and 8) in the axial direction of the rotational shaft 37.

In the centrifugal compressor 1, in response to rotation of the rotational shaft 37, a fluid to be compressed flows into the intake casing 41 through the intake port 41A. The fluid to be compressed passes through the inlet 21, and then through the flow paths R of the impellers 31 to 33 in rotation, and the diffuser 25, before being discharged outside the main casing 2 temporarily.

The fluid discharged from the discharge casing 51 is cooled by a non-depicted cooling device, for instance, and then flows into the intake casing 42 through the intake port 42A. The fluid having flown in passes through the inlet 22, and then through the flow paths R of the impellers 34 to 36 in rotation and the diffuser 26, thus being compressed. The compressed fluid passes through the outlet 24 and the discharge casing 52 to be discharged outside the main casing.

The cleaning-liquid injection device 8 has a plurality of injection holes 82, and a flow path which extends through an annular space and which allows a cleaning liquid to be supplied to the plurality of injection holes 82 to flow through. The flow path of the cleaning-liquid injection device 8 is for supplying a cleaning liquid to the plurality of injection holes 82.

The plurality of injection holes 82 are disposed along the flow guide member 7, and at a distance from one another along the axial direction of the rotational shaft 37.

A cleaning liquid is supplied to the cleaning-liquid injection device 8 from the cleaning-liquid supply device 9. The cleaning-liquid supply device 9 is disposed outside the main casing 2, for instance.

The cleaning-liquid injection device 8 is supplied with the cleaning liquid from the cleaning-liquid supply device 9 intermittently while the centrifugal compressor 1 is operated. The cleaning liquid supplied to the cleaning-liquid injection device 8 is injected from the plurality of injection holes 82 to a fluid guided by the flow guide member 7, is dispersed, and reaches the surfaces of the impellers 31 to 33 with the fluid having flown in. The cleaning liquid having reached the surfaces of the impellers 31 to 33 washes off dust adhering to the surfaces of the impellers 31 to 33 and cleans the surfaces of the impellers 31 to 33.

Accordingly, the cleaning liquid is distributed evenly over the entire region of the flow-path width as described below, and it is possible to clean the entire surfaces of the impellers 31 to 33 sufficiently and evenly.

Figure 6:
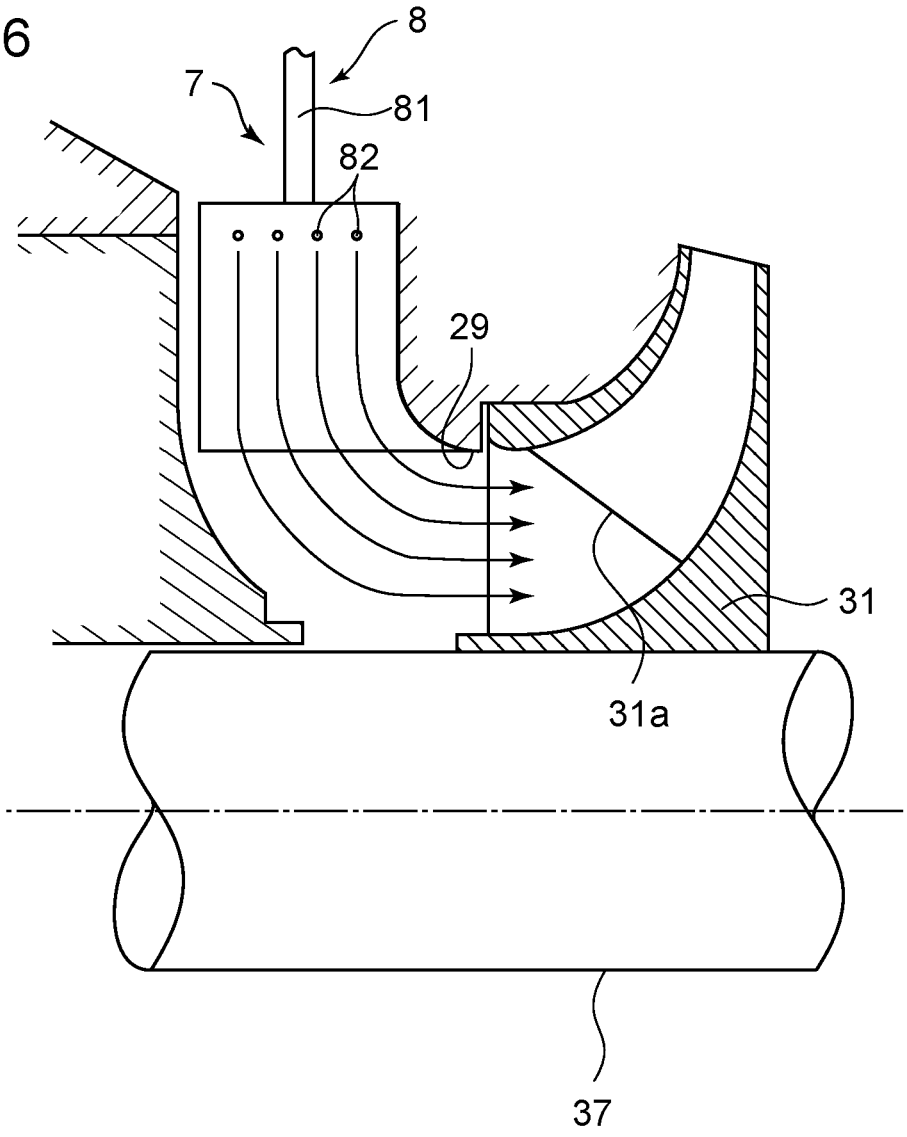
FIG. 6 is a diagram for describing a flow of a cleaning liquid flowing from a flow guide member to an impeller.

A leading edge 31*a* of the impeller 31 faces the annular space 20 along the axial direction of the rotational shaft 37, through an opening of an annular shape about the rotational shaft 37 inside the main casing 2, which is an impeller inlet 29. As depicted in FIG. 6, the fluid having flown into the inlet 21 of the main casing 2 flows along the circumferential direction of the rotational shaft 37 inside the annular space 20, and then flows toward the impeller inlet 29 along the radial direction of the rotational shaft 37. The flowing direction of the fluid gradually changes from the radial direction to the axial direction in the vicinity of the impeller inlet 29, and the fluid flows into the impeller inlet 29 along the axial direction.

In accordance with such a change in the flow direction, the width direction of the flow of the fluid also changes. Specifically, the width direction of the flow is the same as the axial direction of the rotational shaft 37 when the fluid is flowing along the circumferential direction or along the radial direction of the rotational shaft 37 inside the annular space 20, and is the same as the radial direction of the rotational shaft 37 when the fluid is flowing along the axial direction after flowing into the impeller inlet 29.

The flow guide member 7 disposed in the annular space has a function to assist a change in the flow direction of the fluid from the circumferential direction to the radial direction of the rotational shaft.

With this configuration, the cleaning liquid is injected through the plurality of injection holes 82 disposed along the flow guide member 7, and the cleaning liquid immediately after injection is transported by the fluid flowing along the circumferential direction or along the radial direction inside the annular space. Furthermore, since the plurality of injection holes 82 are separated from one another along the axial direction of the rotational shaft 37, the cleaning liquid immediately after injection is dispersed in the axial direction of the rotational shaft 37, i.e., in the width direction of the flow of the fluid.

Thanks to dispersion of the cleaning liquid immediately after injection in the width direction of the flow, the cleaning liquid maintains a state of being dispersed in the width direction of the flow, i.e., the radial direction of the rotational shaft 37, even after the flow direction of the fluid changes from the radial direction to the axial direction of the rotational shaft 37, i.e., after the fluid flows into the impeller inlet 29. Accordingly, when the cleaning liquid reaches the impeller 31, the cleaning liquid is distributed evenly over the entire region of the flow-path width, and the entire surfaces of the impellers 31 can be cleaned sufficiently and evenly.

Figure 4:
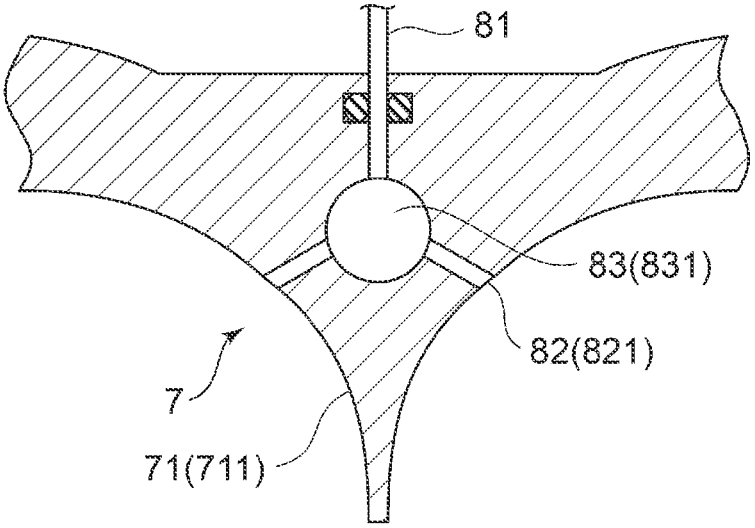
FIG. 4 is a cross-sectional view schematically showing a flow guide member depicted in FIG. 2.
Figure 5:
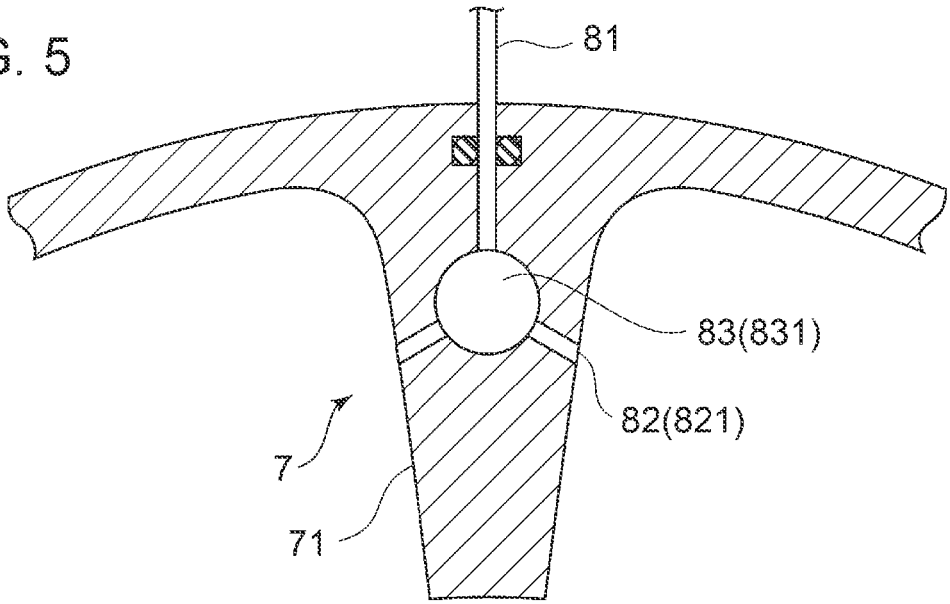
FIG. 5 is a cross-sectional view schematically showing a flow guide member depicted in FIG. 3.

As depicted in FIGS. 4 and 5, in some embodiments, the plurality of injection holes 82 have openings on the surface of the flow guide member 7. The flow path of the cleaning-liquid injection device 8 for supplying the cleaning liquid to the plurality of injection holes 82 is formed by a cleaning-liquid supply pipe 81 and a flow path 83. The flow path 33 extends through the flow guide member 7 (see FIGS. 4 and 5), and the cleaning-liquid supply pipe 81 brings the flow path 83 and the cleaning-liquid supply device 9 into communication.

In the above configuration, since the injection holes 82 have openings on the surface of the flow guide member 7, the cleaning-liquid injection device 8 is less likely to interfere with the flow of the fluid to be compressed.

The flow path 83 only needs to be capable of supplying a cleaning liquid to the injection holes 82, and is not particularly limited. For instance, in the example depicted in FIGS. 4 and 5, a liquid reservoir 831 is disposed inside the flow guide member 7 and each of the injection holes 82 is in communication with the liquid reservoir 831.

Further, the injection holes 82 may be disposed on one side of the flow guide member 7 in the circumferential direction of the rotational shaft 37, or on both sides of the flow guide member 7 as in the examples depicted in FIGS. 4 and 5.

While the injection holes 82 and the flow path 83 are formed by holes formed integrally with the flow guide member 7 in the examples depicted in FIGS. 4 and 5, the flow path 83 and the injection holes 82 may not be integrally formed with the flow guide member 7. For instance, the flow path 83 and the injection holes 82 may be formed by a plurality of pipes disposed along the flow guide member 7 and open ends of the plurality of pipes, or by one pipe disposed in the axial direction of the rotational shaft 37 along the flow guide member 7 and a plurality of openings formed on the peripheral wall of the pipe.

Further, as depicted in FIGS. 2 and 3, in some embodiments, the flow guide member 7 is disposed on the opposite side from the inlet 21 in the circumferential direction of the rotational shaft 37.

With this configuration, since the flow guide member 7 is disposed on the opposite side from the inlet 21 in the circumferential direction of the rotational shaft 37, the cleaning liquid immediately after injection is dispersed in the axial direction of the rotational shaft 37, i.e., in the width direction of the fluid, from the opposite side from the inlet 21.

Furthermore, since the injection holes 82 are disposed along the flow guide member 7 disposed on the opposite side from the inlet 21, the cleaning liquid injected from the injection holes 82 is less likely to adhere to the inner wall surface of the inlet side of the main casing 2. In this way, it is possible to reduce the amount of waste cleaning liquid that is not used in cleaning of the impellers 31 to 33.

In the present embodiment, the inlet 21 is disposed on the bottom surface of the main casing 2, and the flow guide member 7 is disposed on an upper side in the gravity direction, which is the opposite side from the inlet 21 in the circumferential direction, whereby the cleaning liquid is injected in the gravity direction. Accordingly, it is possible to inject the cleaning liquid from the cleaning-liquid injection device 8 (injection holes 82) by applying only a small pressure.

Furthermore, as depicted in FIGS. 2 and 3, in some embodiments, the flow guide member 7 has a flow guide element 71 extending along the radial direction of the rotational shaft 37, and injection holes 821, which is a part of the plurality of injection holes 82, is disposed on the surface of the flow guide element 71.

With this configuration, the injection holes 821 being at least a part of the injection holes 82 is disposed on the surface of the flow guide element 71 extending along the radial direction of the rotational shaft 37, and thereby the cleaning liquid immediately after injection is transported by the fluid flowing along the surface of the flow guide element 71. Furthermore, since the plurality of injection holes 321 are separated from one another along the axial direction of the rotational shaft 37, the cleaning liquid immediately after injection is dispersed in the width direction of the flow guide element 71, i.e., in the width direction of the flow of the fluid.

Furthermore, as depicted in FIG. 2, in some embodiments, the flow guide element 711 constitutes a part of the inlet guide-vane row 6 disposed in the annular space.

With this configuration, since the flow guide element 711 constitutes a part of the inlet-guide-vane row 6 disposed in the annular space, the cleaning liquid immediately after injection is dispersed in the axial direction of the rotational shaft 37, i.e., in the width direction of the flow of the fluid, from the inlet guide vanes 61.

Further, as depicted in FIG. 2, in some embodiments, the flow guide member 7 has a blade element 72 that gradually reduces the flow-path cross-sectional area of the annular space from the inlet 21 toward the flow guide element 71.

With this configuration, the flow guide member 7 is provided with the blade element 72 that gradually reduces the flow-path cross-sectional area of the annular space from the inlet 21 toward the flow guide element 71, and thus a speed decrease of the fluid flowing from the inlet 21 toward the flow guide element 71 is suppressed.

Figure 7:
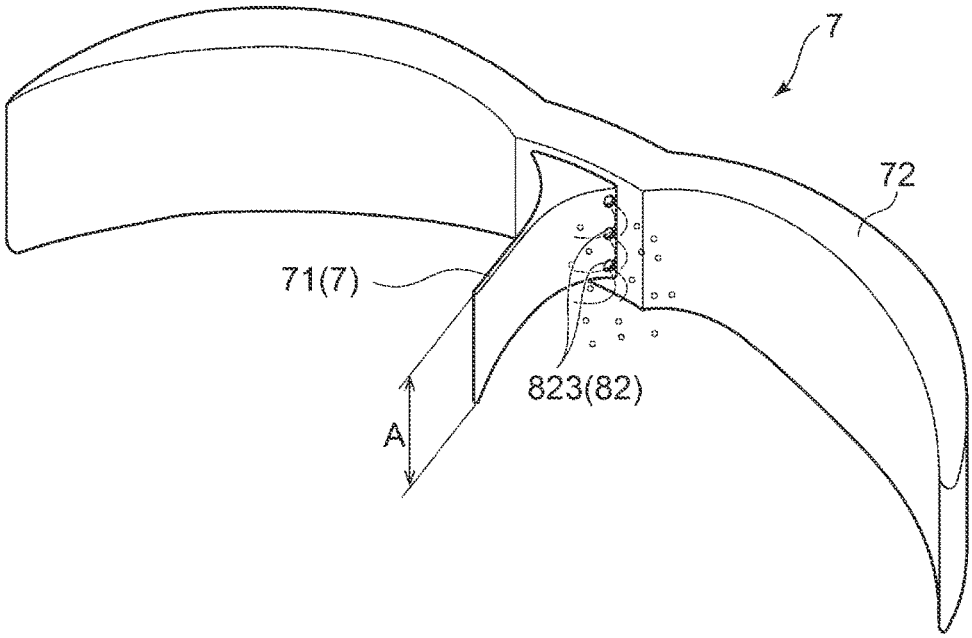
FIG. 7 is a perspective view schematically showing a flow guide member according to an embodiment.

FIG. 7 is a perspective view schematically showing a flow guide member according to an embodiment.

As depicted in FIG. 7, in some embodiments, injection holes 823 being at least a part of the injection holes 82 are aligned in a line along the axial direction of the rotational shaft 37.

With this configuration, the injection holes 823 being at least a part of the injection holes 82, are disposed in a line along the axial direction of the rotational shaft 37, and thereby the cleaning liquid immediately after injection is distributed evenly in the fluid flowing along the circumferential direction or the radial direction inside the annular space. Since the cleaning liquid immediately after injection is distributed evenly in the fluid, the cleaning liquid immediately after injection is dispersed evenly in the axial direction of the rotational shaft 37, i.e., in the width direction of the fluid.

Figure 8:
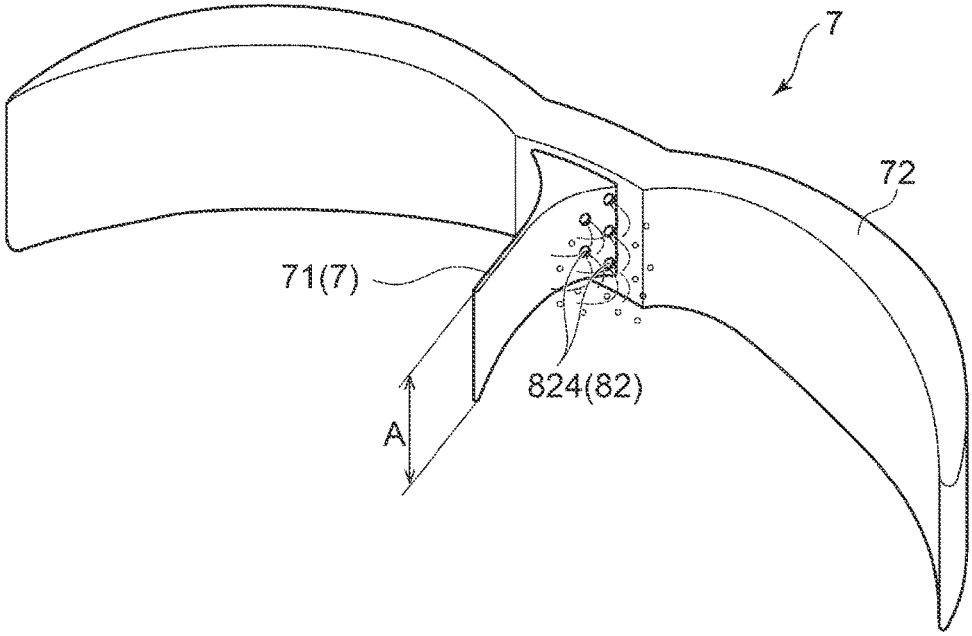
FIG. 8 is a perspective view schematically showing a flow guide member according to an embodiment.

FIG. 8 is a perspective view schematically showing a flow guide member according to an embodiment.

As depicted in FIG. 8, in some embodiments, injection holes 824 being at least a part of the injection holes 82 are arranged in a staggered fashion along the axial direction of the rotational shaft 37.

With this configuration, the injection holes 824 being at least a part of the injection holes 82 are disposed in a staggered fashion along the axial direction of the rotational shaft 37, and the cleaning liquid immediately after injection is distributed evenly and densely in the fluid flowing along the circumferential direction or the radial direction inside the annular space, without interfering with each other. Since the cleaning liquid immediately after injection is distributed evenly and densely in the fluid, the cleaning liquid immediately after injection is dispersed in the axial direction of the rotational shaft 37, i.e., in the width direction of the fluid.

Embodiments of the present invention were described in detail above, but the present invention is not limited thereto, and various amendments and modifications may be implemented.

DESCRIPTION OF REFERENCE NUMERALS

1 Centrifugal compressor
2 Main casing
21, 22 Inlet
23, 24 Outlet
25, 26 Diffuser
27A, 27B Journal bearing
28A, 28B Thrust bearing
29 Impeller inlet
3, 31 to 36 Impeller
31*a* Leading edge
37 Rotational shaft
41, 42 Intake casing
41A, 42A Intake port
41B Partition wall
51, 52 Discharge casing
51A, 52A Discharge port
Inlet guide-vane row
61 Inlet guide vane
7 Flow guide member
71, 711 Flow guide element
72 Blade element
8 Cleaning-liquid injection device
81 Pipe
82, 821, 822, 823, 824 Injection hole
9 Cleaning-liquid supply device
O Axis
R Flow path

The invention claimed is:

1. A centrifugal compressor, comprising:

a rotational shaft;

a main casing surrounding at least a part of the rotational shaft, the main casing having an inlet and an outlet separated from each other in an axial direction of the rotational shaft and an annular space surrounding a section of the rotational shaft at a side of the inlet and communicating with the inlet, wherein a fluid to be compressed before compression flows in the annular space;

at least one impeller disposed in a fixed state to the rotational shaft inside the main casing;

a flow guide member disposed inside the annular space and extending along the axial direction of the rotational shaft, the flow guide member having a flow guide element extending along a radial direction of the rotational shaft and having a predetermined blade width in the axial direction of the rotational shaft;

a plurality of injection holes disposed along the flow guide member and separated from one another along the axial direction of the rotational shaft; and a flow path which extends inside the annular space and through which a cleaning fluid to be supplied to the plurality of injection holes is capable of flowing.

2. The centrifugal compressor according to claim 1, wherein the flow guide member is disposed on a side opposite from the inlet in a circumferential direction of the rotational shaft.

3. The centrifugal compressor according to claim 1, wherein at least a part of the plurality of injection holes is disposed on a surface of the flow guide element.

4. The centrifugal compressor according to claim 3, wherein the flow guide element constitutes a part of an inlet guide-vane row disposed in the annular space.

5. The centrifugal compressor according to claim 1, wherein the flow guide member has a blade element which reduces a flow-path cross sectional area of the annular space from the inlet toward the flow guide element.

6. The centrifugal compressor according to claim 1, wherein at least a part of the plurality of injection holes is arranged in a line along the axial direction of the rotational shaft.

7. The centrifugal compressor according to claim 1, wherein at least a part of the plurality of injection holes is arranged in a staggered fashion along the axial direction of the rotational shaft.

* * * * *